US006953003B1

(12) United States Patent
Mulhern

(10) Patent No.: US 6,953,003 B1
(45) Date of Patent: Oct. 11, 2005

(54) WATERCRAFT LANDING CRADLE

(75) Inventor: Francis M. Mulhern, Riverton, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/738,075

(22) Filed: Dec. 18, 2003

(51) Int. Cl.[7] ..... B63B 35/40
(52) U.S. Cl. ..... 114/259; 114/365
(58) Field of Search ..... 114/44, 45, 258–262, 114/343, 344, 364, 365, 366, 368; 405/1–7; 280/414.1; 414/137.7

(56) References Cited

U.S. PATENT DOCUMENTS

| | | | | | |
|---|---|---|---|---|---|
| 1,410,243 | A | * | 3/1922 | Brown et al. | 405/3 |
| 2,151,394 | A | * | 3/1939 | Rogers | 405/3 |
| 2,325,994 | A | * | 8/1943 | Zoll | 405/3 |
| 2,390,300 | A | * | 12/1945 | Harris | 114/45 |
| 3,437,066 | A | * | 4/1969 | Schwendtner | 114/260 |
| 3,539,065 | A | * | 11/1970 | Brownell | 414/458 |
| 3,721,096 | A | * | 3/1973 | Deckert et al. | 405/7 |
| 4,227,828 | A | * | 10/1980 | Ivanov et al. | 405/1 |
| 4,243,344 | A | * | 1/1981 | Gardon | 405/2 |
| 4,915,577 | A | * | 4/1990 | Fraser | 414/476 |
| 5,234,285 | A | * | 8/1993 | Cameron | 405/2 |
| 5,485,798 | A | * | 1/1996 | Samoian et al. | 114/44 |
| 5,544,606 | A | * | 8/1996 | Schmidt, Jr. | 114/48 |
| 5,613,462 | A | * | 3/1997 | Schwartz | 114/362 |
| 6,047,659 | A | * | 4/2000 | Schmidt, Jr. | 114/369 |
| 6,055,924 | A | * | 5/2000 | Marshall et al. | 114/242 |
| RE37,061 | E | * | 2/2001 | Stokoe et al. | 405/1 |
| 6,502,525 | B2 | * | 1/2003 | Burke | 114/259 |
| 6,591,770 | B1 | * | 7/2003 | Blackmore | 114/48 |
| 6,782,842 | B1 | * | 8/2004 | Alvord | 114/369 |
| 6,786,170 | B2 | * | 9/2004 | Trowbridge | 114/259 |

FOREIGN PATENT DOCUMENTS

| | | | | | |
|---|---|---|---|---|---|
| DE | 4109578 | A1 | * | 9/1992 | B63C 3/06 |
| EP | 196433 | A1 | * | 10/1986 | B63C 5/04 |
| FR | 2620405 | A1 | * | 3/1989 | B62D 63/08 |
| JP | 58211992 | A | * | 12/1983 | B63C 5/04 |
| JP | 58211993 | A | * | 12/1983 | B63C 5/04 |
| JP | 60056696 | A | * | 4/1985 | B63C 13/00 |
| JP | 63137096 | A | * | 6/1988 | B63C 1/02 |
| JP | 01078999 | A | * | 3/1989 | B63C 1/02 |
| JP | 01085896 | A | * | 3/1989 | B63C 1/02 |
| JP | 03235794 | A | * | 10/1991 | B63C 1/02 |
| JP | 03253490 | A | * | 11/1991 | B63C 15/00 |

* cited by examiner

*Primary Examiner*—S. Joseph Morano
*Assistant Examiner*—Ajay Vasudeva
(74) *Attorney, Agent, or Firm*—Jacob Shuster

(57) ABSTRACT

A parallelgram arrangement of linkages interconnect a stern ramp frame with a plurality of parallel rails vertically adjusted to positions above the ramp frame by actuators for reception and maintenance of a watercraft thereon with minimized vibration, further reduced by shock-absorbing springs positioned in engagement with the rails and the rail actuators. Rail positioning adjustment by the actuators is effected under computer control to match different hull shapes of the watercraft that are curved or v-shaped and therefore non-flat.

2 Claims, 3 Drawing Sheets

WATERCRAFT LANDING CRADLE

STATEMENT OF GOVERNMENT INTEREST

The invention described herein may be manufactured and used by or for the Government of the United States of America for governmental purposes without the payment of any royalties thereon or therefore.

The present invention relates to landing reception of watercraft on the stern ramp of sea vessels.

BACKGROUND OF THE INVENTION

Watercraft are currently retrieved from a body of seawater onto a retrieval ship, involving use of a ramp projected from the stern of the ship onto which the watercraft is landed. Such ramp landing of watercraft often effects impact damage thereof because of hydrodynamic turbulence and ship motion, imposing displacement of the watercraft on the ramp. It is therefore an important object of the present invention to avoid the foregoing watercraft damage imposing problems during retrieval of watercraft onto ships.

SUMMARY OF THE INVENTION

Pursuant to the present invention a rectangular ramp frame attached to the stern of a ship is provided with a plurality of parallel spaced horizontally elongated rails onto which a watercraft is landed and retained during retrieval onto the ship. Such rails are maintained in horizontal positions vertically spaced above the ramp frame by adjusted amounts in a parallelgram arrangement of linkages so that the vertical positions of the rails may be selectively varied to accommodate watercraft with different hull shape cross-sections. Such rail adjustment is effected through actuators pivotally interconnecting the rails with one end of the frame, under selective computer control. Watercraft are accordingly received on rails adjusted to match their hull shape for retention on the ramp frame with vibration due to sea condition reduced. Further vibration reduction is effected, by shock-absorbing springs in engagement with the rails at the ends thereof to which the actuators are connected.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
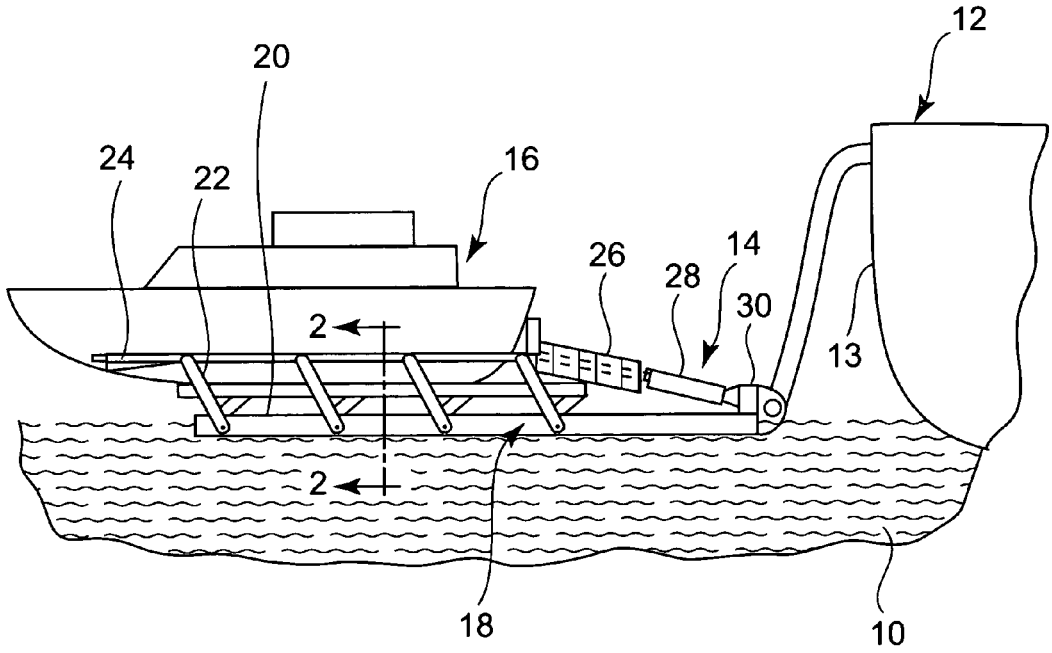
FIG. 1 is a side elevation view of a watercraft landed onto a floating ramp cradle attached to the stern of a retrieval ship.

Referring now to the drawing in detail, FIG. 1 illustrates a body of seawater 10 underlying a ship 12 floating thereon having a stern end 13 to which a cradle ramp 14 is attached for landing or reception thereon of a watercraft 16, such as a small boat or unmanned sea vehicle. The watercraft 16 received on the cradle ramp 14 from a location on the surface of the seawater 10 or from a location submerged therein may be transferred from the ramp cradle 14 onto the stern of the ship 12 as generally known in the art. However pursuant to the present invention, the cradle ramp 14 is selectively adjusted in configuration prior to reception of the watercraft 16 thereon to avoid damaging thereof during reception and retrieval onto the ship 12 from its seawater location.

Figure 2:
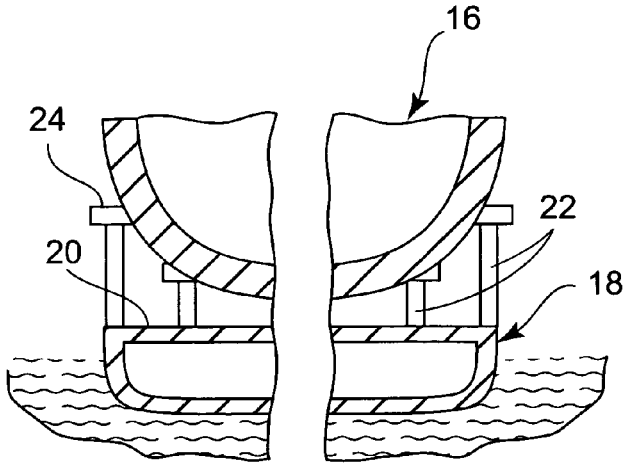
FIG. 2 is a partial section view taken substantially through a plane indicated by section line 2—2 in FIG. 1.
Figure 3:
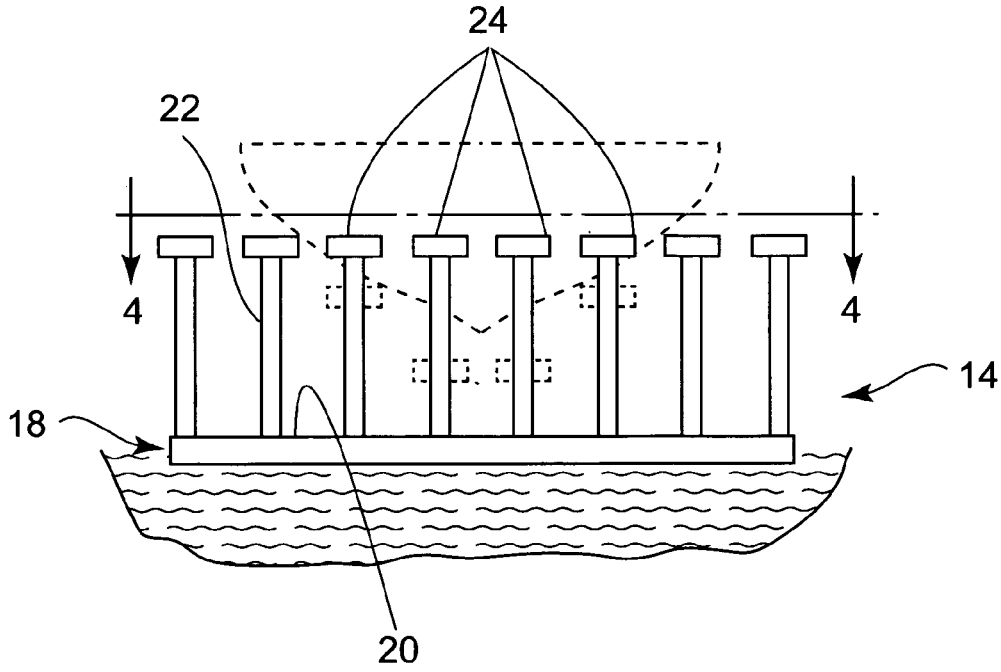
FIG. 3 is a front elevation view of the floating ramp cradle with all landing rails horizontally aligned in their topmost positions.
Figure 4:
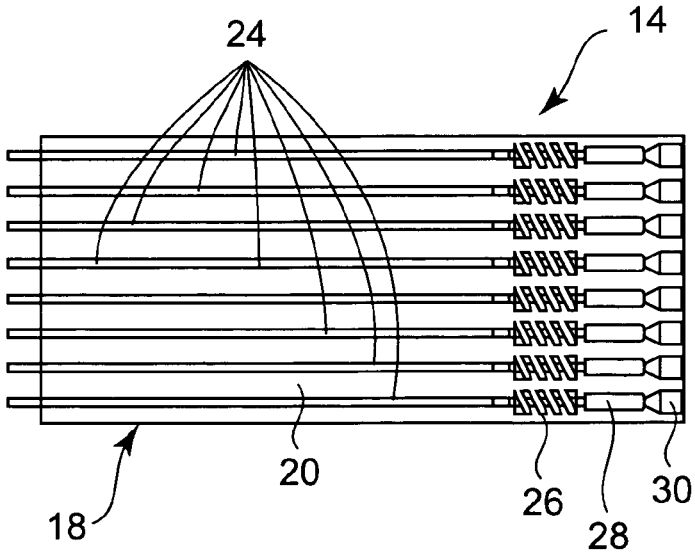
FIG. 4 is a top elevation view of the ramp cradle as seen from section line 4—4 is in FIG. 3.

As shown in FIGS. 1–4, the cradle ramp 14 includes a bottom floating frame 18 having a top rectangular support surface 20, with a plurality of parallelgram linkages 22 pivotally interconnected between rails 24 and at spaced locations on the frame 18 for horizontally positioning of a plurality (8 to 10) of the rails 24, disposed in parallel spaced relation to each other as shown in FIGS. 3 and 4. One end of each of the rails 24 projects beyond the top frame surface 20, while the other rail end is connected to an actuator 28 pivotally connected to the end of the frame 18 by a pivot anchor 30. Such actuators 28 extend through shock-absorbing coil springs 26 in abutment with the ends of the rails 24 opposite the other ends projecting beyond the frame 18. Thus, each of the rails 24 is displaced horizontally by its actuator 28 so as to effect pivotal displacement of the linkages 22 extending therefrom to the bottom frame 18, so as to effect vertical displacement of the rails 24 by different amounts between lower and higher horizontal positions as shown in FIG. 2, corresponding to the hull shape of the watercraft 16 received thereon.

Figure 5:
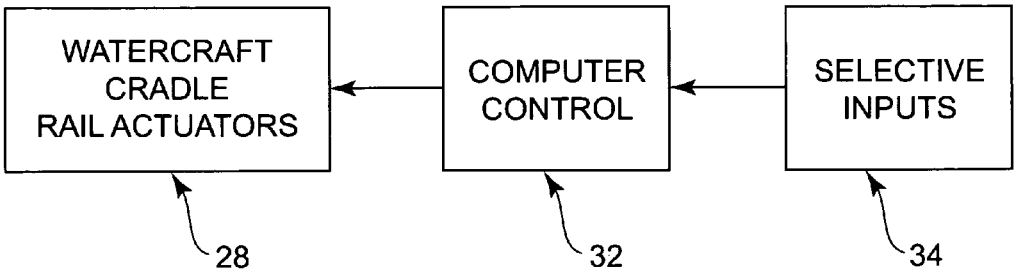
FIG. 5 is a diagram of the rail adjustment system associated with the ramp cradle shown in FIGS. 1–4.

Accordingly, vertical positioning of the rails 24 is selectively varied from their horizontally aligned top positions as shown in FIG. 3 in order to conform to the hull shape of the watercraft 16, which is generally cylindrical as shown in FIG. 2. Other differently shaped watercraft hulls, such as V-shaped hulls, may also be accommodated by positional adjustment of the rails 24 through the rail actuators 28 under computer control 32 as diagrammed in FIG. 5. In response to selective inputs 34, differently shaped watercraft hulls may thereby be landed on the cradle ramp 14 with minimized impact after controlled adjustment of the rails 24, while impact induced vibrations because of sea conditions are thereafter reduced by the shock-absorbing springs 26.

Figure 6:
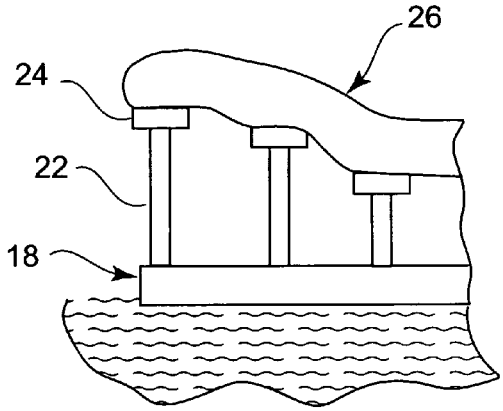
FIG. 6 is a partial front elevation view corresponding to that of FIG. 3, showing the rails in adjusted positions with an inflated shock-absorbing cover thereon.

According to other embodiments of the present invention, an inflatable cover 36 may be placed onto the adjusted rails 24 as shown in FIG. 6, before landing of a watercraft thereon.

Obviously, other modifications and variations of the present invention may be possible in light of the foregoing teachings. It is therefore to be understood that within the scope of the appended claims the invention may be practiced otherwise than as specifically described.

What is claimed is:

1. A cradle on which a water craft is landed, comprising: a seawater floating frame; a plurality of elongated rails on which the landed watercraft is positioned above the frame; linkage means operatively interconnecting the frame with the rails for movement thereof to adjusted positions differently spaced from the frame; actuator means connected to the rails for selectively imparting said movement thereto to said adjusted positions corresponding to cross-sectional hull shape of the watercraft prior to landing of the watercraft on the cradle; and spring means engaged with the rails and the actuator means for shock-absorption of vibrations imparted to the watercraft during retention on the rails after being landed thereon.

2. In combination with a retrieval ship having a stern, a cradle ramp connected to the stern on which a watercraft is landed, comprising: a frame; a plurality of elongated rails; linkage means operatively interconnecting the frame with the rails for movement thereof between positions differently spaced from the frame; actuator means connected to the rails for selectively imparting said movement thereto to said positions adjusted to correspond to cross-sectional hull shape of the watercraft; and spring means engaged with the rails and the actuator means for shock-absorption of vibrations imparted to the watercraft during retention on the rails after being landed thereon.

* * * * *